United States Patent [19]

Young, Jr.

[11] Patent Number: 4,565,401

[45] Date of Patent: Jan. 21, 1986

[54] CARRIER FOR EMPTY CONTAINERS

[76] Inventor: John A. Young, Jr., 372 Central Park West, New York, N.Y. 10025

[21] Appl. No.: 621,507

[22] Filed: Jun. 18, 1984

[51] Int. Cl.[4] ..... B65D 6/40; B65D 6/08

[52] U.S. Cl. ..... 294/159; 294/143

[58] Field of Search ..... 294/159, 143, 172, 161, 294/87 A; 220/19, 22, 334; 206/202, 139

[56] References Cited

U.S. PATENT DOCUMENTS 4,026,220 5/1977 Schuring, Jr. ..... 294/143

FOREIGN PATENT DOCUMENTS 1323069 2/1963 France ..... 294/159

*Primary Examiner*—James B. Marbert

*Attorney, Agent, or Firm*—Brumbaugh, Graves, Donohue & Raymond

[57] ABSTRACT

In the representative embodiment of the invention disclosed in the specification, a pair of holder units for empty bottles and cans is disclosed in which each holder unit has a bottom tray member and a positioning member with openings to receive the upper portions of cans or bottles, the tray member and positioning member being held in spaced relation by support rods. A handle member is removably received in receptacles in the lower surface of the positioning member of the upper holder unit and the lower unit is releasably attached to the upper unit by pads made of a gripping fabric.

1 Claim, 2 Drawing Figures

CARRIER FOR EMPTY CONTAINERS

BACKGROUND OF THE INVENTION

This invention relates to carriers for empty cans and bottles and, more particularly, to a new and improved lightweight carrier for empty cans and bottles which can be assembled easily using components which can be packed in a compact package for sale.

In order to maintain a litter-free landscape various efforts have been made to induce consumers to keep and return empty containers such as cans and bottles. In many areas a deposit must be made on purchase of such containers which is refunded only if the empty container is returned in a substantially undamaged condition.

Heretofore even when empty bottles and cans are to be returned, they are often kept in a large bag or box in a disorganized fashion which may result in breakage of bottles and damage to cans.

Accordingly, it is an object of the present invention to provide a new and improved holder and carrier for empty containers which retains the containers in an organized manner and preserves them from breakage or damage.

Another object of the invention is to provide a new and improved holder for bottles and cans which also functions as a carrier for one or more holder segments.

A further object of the invention is to provide a holder and carrier for empty bottles and cans which can be packaged in compact form and assembled quickly and conveniently by the user.

These and other objects of the invention are attained by providing a flat tray member, an apertured positioning member, and a plurality of spacers adapted to hold the positioning member in spaced relation to the tray member. A handle member with depending end portions is adapted to engage receptacles in the positioning member so that the assembled holder unit can be carried conveniently. To permit two or more holder units to be joined and carried at the same time, releasable fabric gripping elements are affixed at corresponding locations on the upper surface of the positioning member and the lower surface of the tray member.

BRIEF DESCRIPTION OF THE DRAWINGS

Further objects and advantages of the invention will be apparent from a reading of the following description of a preferred embodiment in conjunction with the accompanying drawings in which.

DETAILED DESCRIPTION OF A PREFERRED EMBODIMENT

Figure 1:
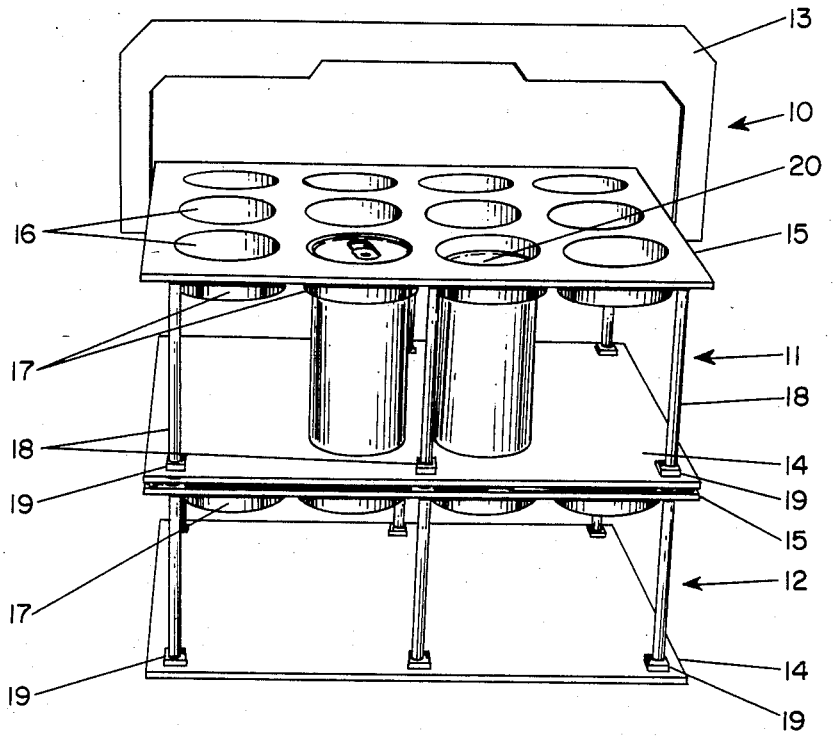
FIG. 1 is a perspective view illustrating a representative embodiment of the invention incorporating two joined holder units supported by a handle.

In the representative embodiment of the invention illustrated in FIG. 1, a holder and carrier 10 for empty cans and bottles comprises two holder units 11 and 12 mounted one on top of the other, and a handle 13 removably attached to the upper holder unit 11. Each holder unit comprises a lower tray member 14 and an upper positioning member 15 extending parallel to the tray member and provided with a series of openings 16 having a diameter corresponding generally to the size of a bottle or can to be retained. Projecting downwardly from the periphery of each opening 16 is a circular retainer 17 which facilitates retention of a can or bottle 20 that is shorter than the spacing between the lower tray 14 and the positioning member 15.

Six support rods 18, located at the corners and the centers of the longer sides of the unit, retain the tray member 14 and the positioning member 15 in fixed spaced relationship. The support rods 18 have threaded ends which are received in extensions 19 projecting from the tray member and the positioning member. The rods 18 are long enough to permit a tall can to be held in the holder unit without projecting above the top surface of the retainer 15 while allowing the circular retainer 17 to hold a shorter can.

Figure 2:
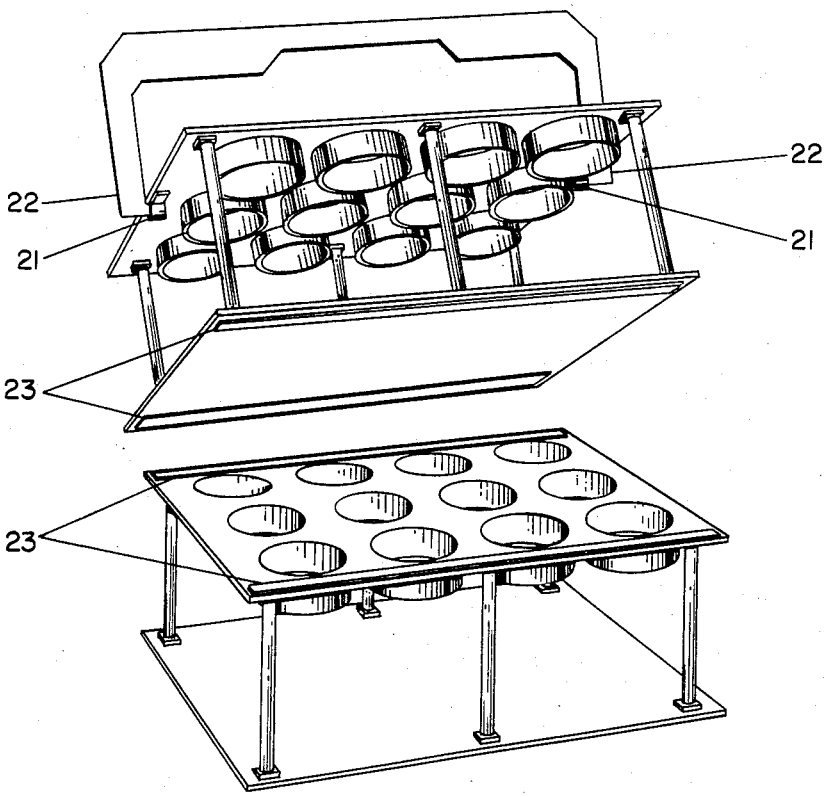
FIG. 2 is a perspective view of the embodiment illustrated in FIG. 1 showing the upper holder unit separated from the lower holder unit.

As best seen in FIG. 2 the bottom surface of the positioning member 15 has receptacles 21 formed at opposite ends to receive projections 22 extending from the ends of the handle member 13. Preferably, the handle member 13, as well as all of the other structural components of the holder of the invention are made of a relatively strong plastic material and the shape of the handle permits the ends to be resiliently separated sufficiently to insert the pins 22 into the receptacles 21.

As also illustrated in FIG. 2, two strips 23 made of releasable gripping fabric material, such as "Velcro", having an adhesive backing, are mounted along the long sides of the upper surface of the positioning member 15 and at corresponding locations on the lower surface of the tray member 14. The holding force of these strips is sufficient to support at least one and preferably two or three additional holder units filled with empty cans so that several units may be stacked together and be carried by a single handle in the manner illustrated in FIG. 1.

With the unique structure of the invention as illustrated in FIGS. 1 and 2, one or more holder units, together with an accompanying handle, may be packaged for sale in a simple compact package having a thickness equal to the thickness of the positioning member 15 with its retainer portions 17 combined with the thickness of the tray member 14 and the projections 19. In preparing a compat package of the components the support rods 18 may be packaged in an envelope inserted between the retainers 17 and the handle 13 may be positioned so as to embrace the retainers on the positioning member 15.

To assemble each holder unit of the invention the purchaser need only attach the support rods 18 to the threaded projection in the members 14 and 15 and insert the ends 22 of the handle 13 into the receptacles 21 of the member 15.

Although the invention has been described herein with reference to a specific embodiment, many modifications and variations therein will readily occur to those skilled in the art. Accordingly, all such variations and modifications are included within the intended scope of the invention as defined by the following claims.

I claim:

1. A carrier for empty containers, comprising: a first and second holder unit, each said holder unit including a flat tray member, a container positioning member having a plurality of openings to recieve the upper portions of containers positioned on said tray member, said positioning member having a projection surrounding each opening which extends in a direction toward said tray member to receive the upper portion of a container supported on said tray member, a plurality of support members affixed at opposite ends to said tray member and said positioning member to hold them in spaced relation, receptacle means formed at opposite ends of the lower surface of said positioning member; a handle having projections adapted to be received in said receptacle of one of said holder units; a plurality of fabric gripping elements mounted at selected locations on the top surface of said positioning member of said first holder unit; and a corresponding plurality of fabric gripping elements positioned at corresponding locations on the bottom surface of said tray member of said second holder unit so as to permit said first and said second holder units to be releasably joined in stacked relationship.

* * * * *